US008894441B2

(12) United States Patent
Wu et al.

(10) Patent No.: US 8,894,441 B2
(45) Date of Patent: Nov. 25, 2014

(54) CABLE ASSEMBLY WITH NEW ARRANGEMENT OF TERMINALS

(71) Applicants: Jerry Wu, Irvine, CA (US); Jun Chen, Kunshan (CN)

(72) Inventors: Jerry Wu, Irvine, CA (US); Jun Chen, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 177 days.

(21) Appl. No.: 13/684,184

(22) Filed: Nov. 22, 2012

(65) Prior Publication Data

US 2013/0130548 A1 May 23, 2013

(30) Foreign Application Priority Data

Nov. 22, 2011 (CN) ..... 2011 1 0372637

(51) Int. Cl.

| | |
|---|---|
| ***H01R 13/648*** | (2006.01) |
| ***H01R 24/60*** | (2011.01) |
| ***H01R 13/6598*** | (2011.01) |
| ***H01R 13/6593*** | (2011.01) |
| ***H01R 13/6471*** | (2011.01) |
| *H01R 13/6464* | (2011.01) |
| *H01R 107/00* | (2006.01) |

(52) U.S. Cl.

CPC ..... *H01R 24/60* (2013.01); *H01R 13/6464* (2013.01); *H01R 13/6598* (2013.01); *H01R 13/6593* (2013.01); *H01R 13/6471* (2013.01); *H01R 2107/00* (2013.01)

USPC ..... 439/607.01; 439/660

(58) Field of Classification Search

CPC ..... H01R 4/646; H01R 13/658; H01R 13/65802; H01R 23/688; H01R 23/7073

USPC ..... 439/79, 95, 98, 108, 607.01, 607.46, 439/607.54–607.56, 660, 939

See application file for complete search history.

(56) References Cited

U.S. PATENT DOCUMENTS

| | | | | |
|---|---|---|---|---|
| 6,077,115 | A * | 6/2000 | Yang et al. | 439/567 |
| 6,945,796 | B2 * | 9/2005 | Bassler et al. | 439/101 |
| 7,090,534 | B2 * | 8/2006 | Wu et al. | 439/607.41 |
| 7,390,220 | B1 * | 6/2008 | Wu | 439/607.06 |
| 7,462,071 | B1 * | 12/2008 | Wu | 439/607.05 |
| 7,591,683 | B2 * | 9/2009 | Zhang et al. | 439/638 |
| 7,614,920 | B1 * | 11/2009 | Yi | 439/682 |
| 7,686,656 | B2 * | 3/2010 | Zheng et al. | 439/660 |
| 7,744,426 | B2 * | 6/2010 | Zheng et al. | 439/660 |
| 7,758,374 | B2 * | 7/2010 | Yu et al. | 439/493 |
| 7,837,499 | B1 * | 11/2010 | Chen | 439/541.5 |

FOREIGN PATENT DOCUMENTS

| | | |
|---|---|---|
| CN | 201191654 | 2/2009 |
| CN | 201639092 | 11/2010 |

* cited by examiner

*Primary Examiner* — Thanh Tam Le

(74) *Attorney, Agent, or Firm* — Wei Te Chung; Ming Chieh Chang

(57) ABSTRACT

A cable assembly comprises a housing, a plurality of terminals received in the housing and divided into several terminal groups and a cable electrically connected with the plurality of terminals. Each terminal group comprises a pair of signal terminals and a grounding terminal. Each terminal defines a body portion, a mating portion extending forwardly from a front end of the body portion, and a terminating portion extending rearwardly from a rear end of the body portion. The two mating portions of the pair of signal terminals and a mating portion of the grounding terminal of each terminal group are located on two different rows, and two terminating portions of the pair of signal terminals and a terminating portion of the grounding terminal of each terminal group are located on a same row.

3 Claims, 12 Drawing Sheets

CABLE ASSEMBLY WITH NEW ARRANGEMENT OF TERMINALS

BACKGROUND OF THE INVENTION

1. Field of the Invention

The present invention generally relates to a cable assembly, and more particularly to a cable assembly for transmitting high-speed signal.

2. Description of Related Art

Usually, a personal computer (PC) or consumer electronics (CE) product has a display for displaying video, and a cable assembly is needed to connect an interface of the display and a control device. A display port connector may be an ideal input/output (I/O) port adapted for both PC and CE products. However, cross talk may occur at interface section of the display port connector, which in turn may influence the quality of signals.

For example, U.S. Pat. No. 7,390,220 disclose a cable assembly comprising an insulated housing defining a receiving space, a plurality of terminals arranged into an upper and a lower terminal rows and received in the insulated housing, a metallic shell surrounding the insulated housing, a metal plate disposed between the upper terminal row and the lower terminal row, and a cable including a number of wires electrically connecting to the terminals and the metal plate. The terminals comprise a plurality of signal terminals and grounding terminals. In order to improve the high frequency performance of the cable assembly, the two mating sections of two adjacent signal terminals of the upper (or lower) terminal row and the mating section of a ground terminal of the lower (or upper) terminal row are structured in an isosceles triangle. And, the two tail sections of two adjacent signal terminals of the upper or lower terminal row and a tail section of a ground terminal of lower or upper terminal row are structured in an isosceles triangle structure. Obviously, the tail sections of two adjacent signal terminals and a ground terminal are located on different rows. As a result, inner signal and grounding conductive wires of the cable are difficult and complicated to solder to the tail sections of the two signal terminals and the ground terminals located on different rows. And, a metallic shielding layer of the cable is needed to be peeled for a longer distance to meet signal and grounding conductive wires surrounding by the metallic shielding layer soldered to the tail sections of the two signal terminals and the ground terminals located on different rows. As two signal wires or a grounding wire should be bent, high frequency performance of the cable assembly will not be performed good enough.

An improved cable assembly having a different arrangement of terminals is desired.

SUMMARY OF THE INVENTION

Accordingly, an object of the present invention is to provide a cable assembly with improved arrangement of the terminals to achieve good high frequency performance and having simple and easily manufacturing process.

In order to achieve the object set forth, a cable assembly in accordance with the present invention comprises a cable assembly comprising: a housing; a plurality of terminals received in the housing and divided into several terminal groups. Each terminal group comprises a pair of signal terminals and a grounding terminal. Each terminal defines a body portion, a mating portion extending forwardly from a front end of the body portion, and a terminating portion extending rearwardly from a rear end of the body portion. And a cable is electrically connected with the plurality of terminals. The two mating portions of the pair of signal terminals and a mating portion of the grounding terminal of each terminal group are located on two different rows, and two terminating portions of the pair of signal terminals and a terminating portion of the grounding terminal of each terminal group are located on a same row.

Other objects, advantages and novel features of the invention will become more apparent from the following detailed description when taken in conjunction with the accompanying drawings.

DETAILED DESCRIPTION OF THE INVENTION

Figure 1:
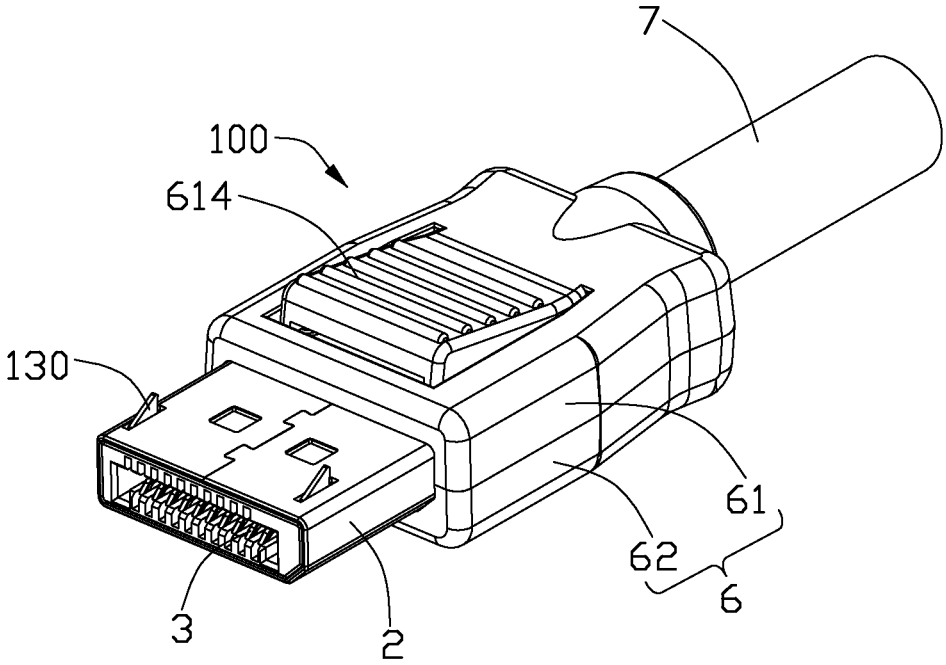
FIG. 1 is an assembled, perspective view of a cable assembly in accordance with a first embodiment of the present invention.

Reference will now be made in detail to the preferred embodiment of the present invention.

Referring to FIGS. 1-8, a cable assembly 100 in accordance with the present invention comprises an insulated housing 2, a plurality of terminals 3 arranged on a spacer 4 and then together received in the insulated housing 2, a metallic plate 5 embedded in the spacer 4, a metallic shell 1 enclosing the insulated housing 2, a cable 7 electrically connected to the terminals 3, and a cover 6 partially shielded the metallic shell 1 and the cable 7.

Referring to FIGS. 2-3 and 5-6, the insulated housing 2 comprises a top wall 23, an opposite bottom wall 21, and a pair of side walls 22, 24 connecting with the top and the bottom walls 23, 21. The insulated housing 2 defines a receiving space 20 formed by the top wall 23, the bottom wall 21 and two side walls 22, 24. The top wall 21 and the bottom wall 22 respectively defines a plurality of terminal passages 25 formed on an inner surface thereof. The top wall 23 and the bottom wall 21 respectively defines two spaced protruding portions 210 formed thereon. Each of protruding portions 210 defines a locking member 211 formed thereon. The top wall 23 defines two slits 230 formed on a top surface thereof. Each of side wall 22, 24 defines a protrusive portion 231 formed on a rear end thereof.

Figure 2:
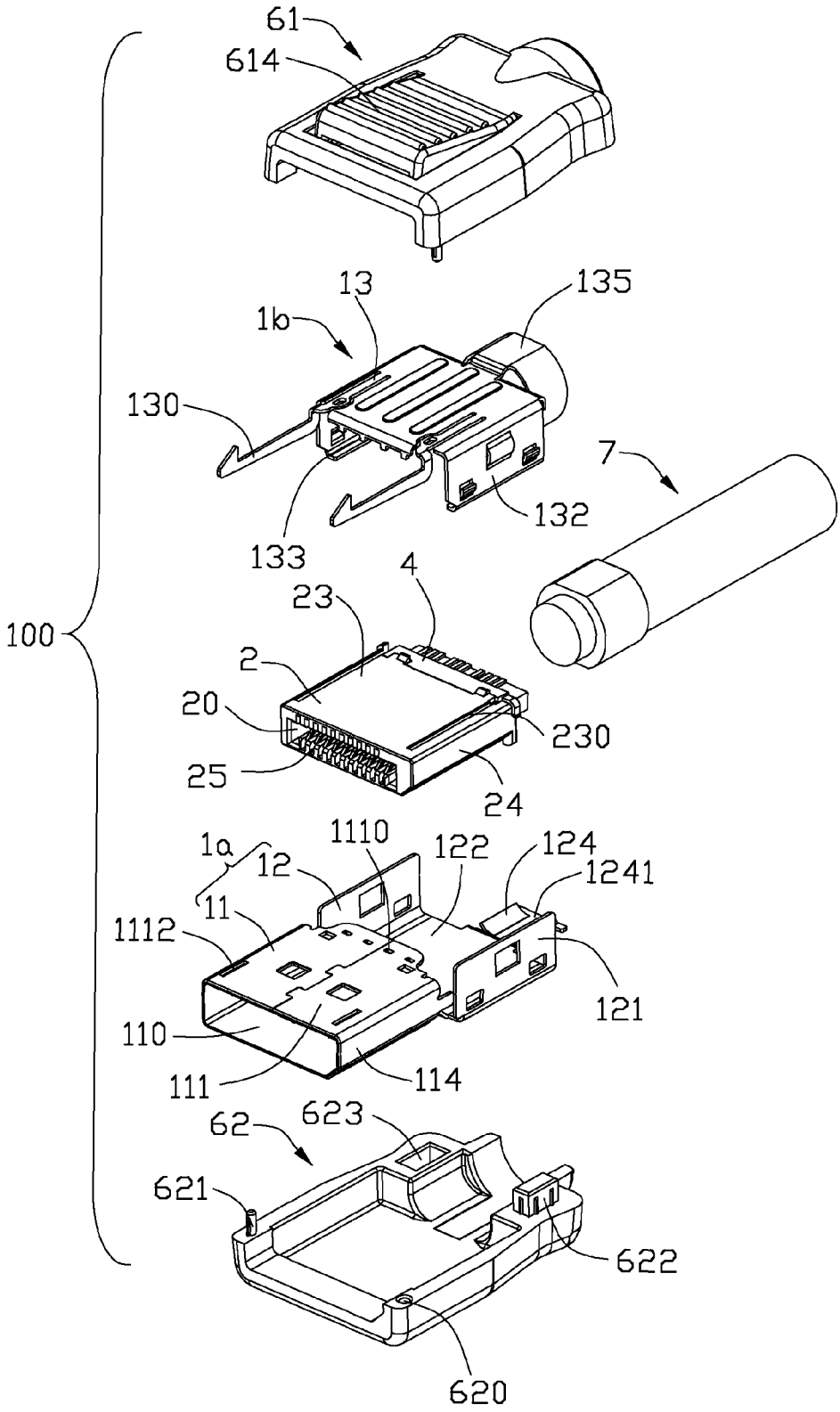
FIG. 2 is an exploded, perspective view of FIG. 1.
Figure 3:
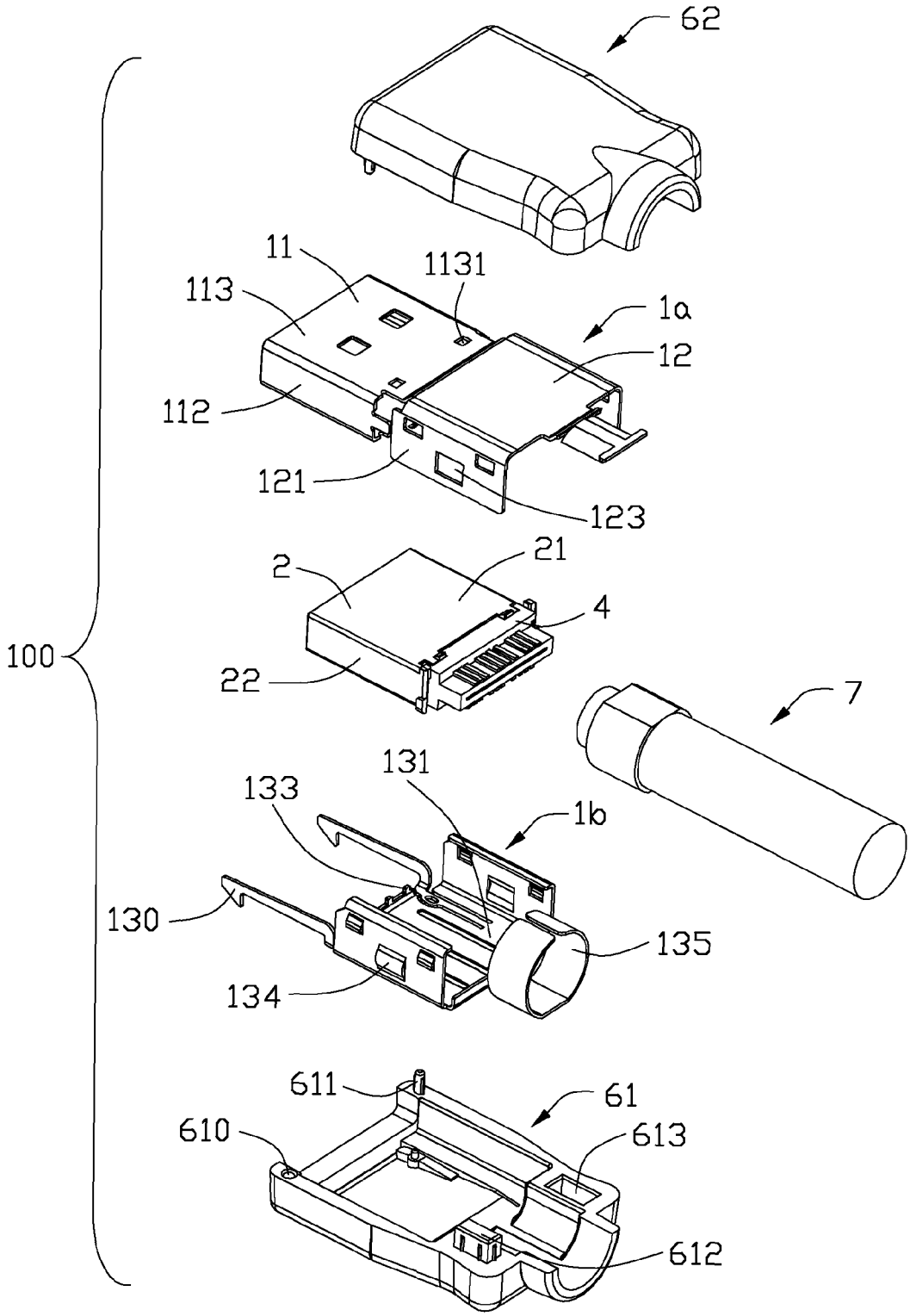
FIG. 3 is similar to FIG. 2, but viewed from another aspect.

Referring to FIGS. 1-3, the metallic shell 1 comprises a first shield portion 1*a* and a second shield portion 1*b* assembled with each other. The first shield portion 1*a* comprises a front frame portion 11 defining a bottom side 113, an opposite top side 111, and a pair of lateral sides 112, 114 connecting the top and the bottom sides 111, 113 to form a receiving room 110 for receiving the insulated housing 2. The top side 111 defines four holes 1110 formed on a rear section thereof. And, the top and bottom sides 111, 113 respectively defines a pair of apertures 1131 formed thereof. The top side 111 further defines two slots 1112 formed thereon. The first shield portion 1*a* further comprises a rear U-shaped portion 12 rearward extending from a lower side 113 of the front frame portion 11. The rear U-shaped portion 12 also comprises a bottom section 122 and a pair of side sections 121 extending upwardly from two sides of the bottom section 122 and a supporting section 124 extending rearward from a rear edge of bottom section 122. The supporting section 124 defines a flat section 1241 formed on a middle section thereof. Each side section 121 of the rear U-shaped portion 12 defines three locking holes 123. The second shield portion 1*b* comprises a n-shaped portion 13 and a cable holder 135 extending rearwardly from a rear edge of the n-shaped portion 13. The n-shaped second portion 13 also comprises a top section 131, a pair of side sections 132 extending downwardly from two sides of the top section 131. The second shield portion 1*b* further comprises a pair of locking arms 130 extending forwardly from a front edge of the n-shaped portion 13. Each side section 132 defines three locking tabs 134 cooperated with three corresponding locking holes 123 of the side section 121 of the rear U-shaped portion 12. The top section 131 further defines four tabs 133 cooperated with four holes 1110.

Figure 4:
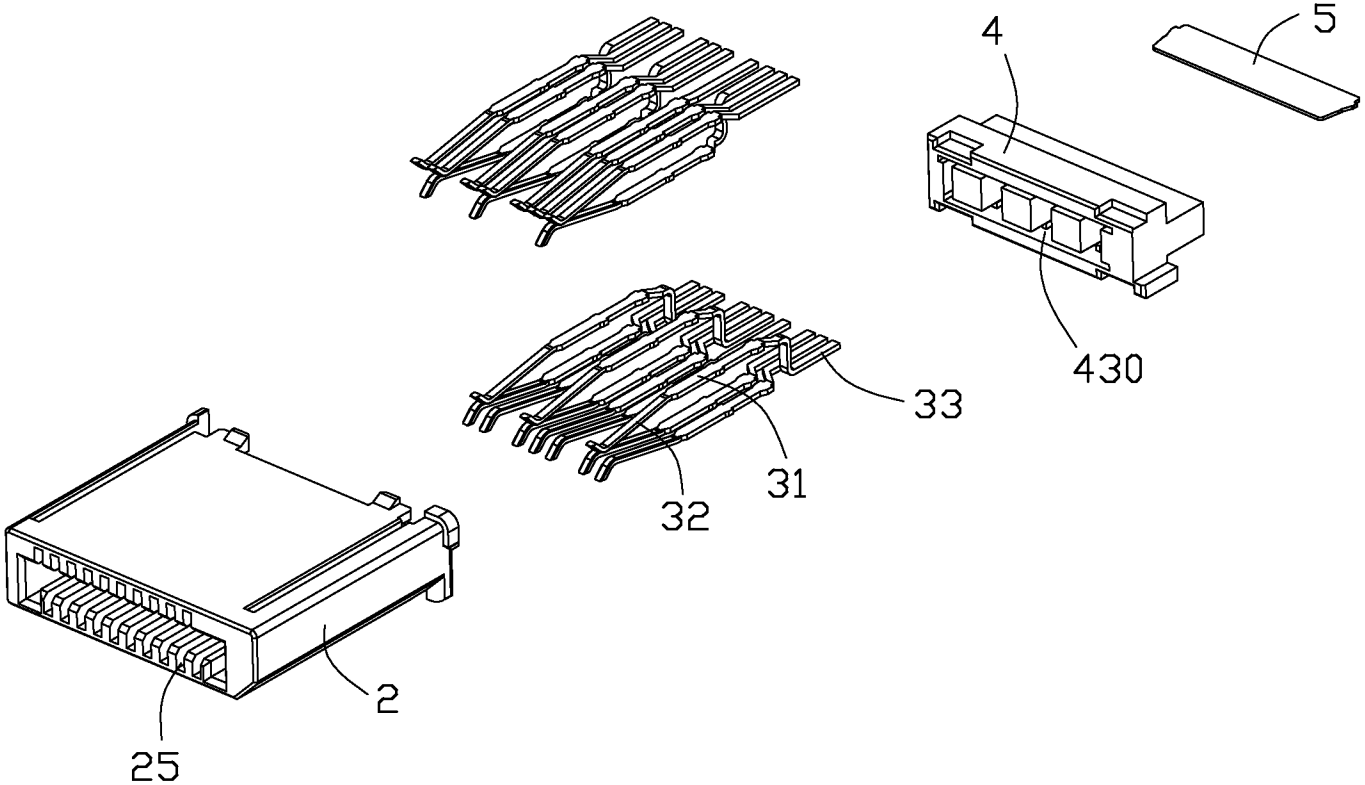
FIG. 4 is an exploded view of an insulated housing, a number of terminals, a spacer, and a metallic plate of the cable assembly of FIG. 2.
Figure 5:
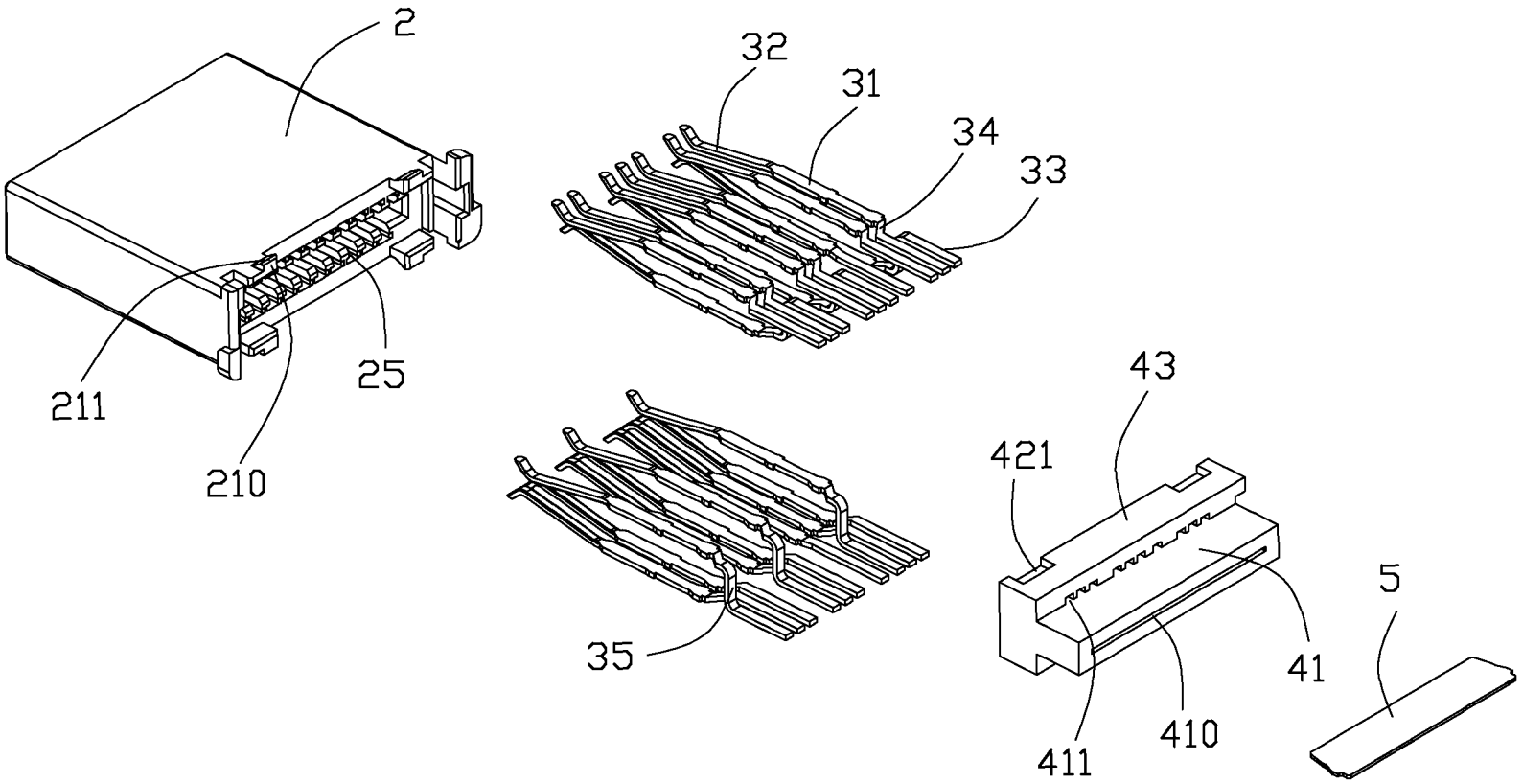
FIG. 5 is similar to FIG. 4, but viewed from another aspect.
Figure 6:
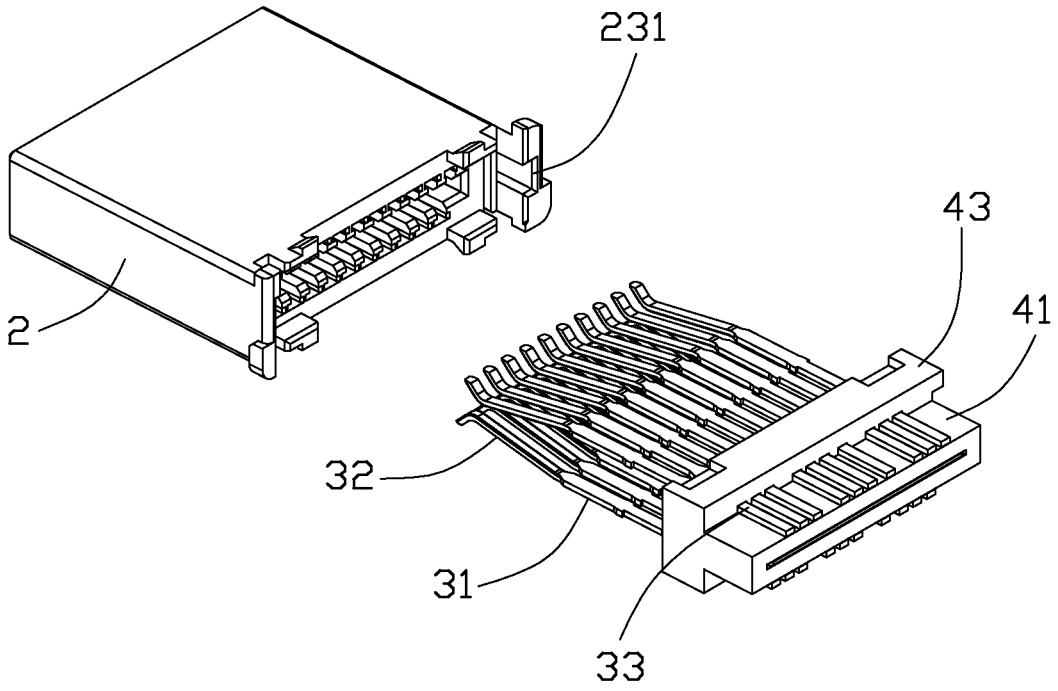
FIG. 6 is a partially assembled, perspective view of FIG. 5.
Figure 7:
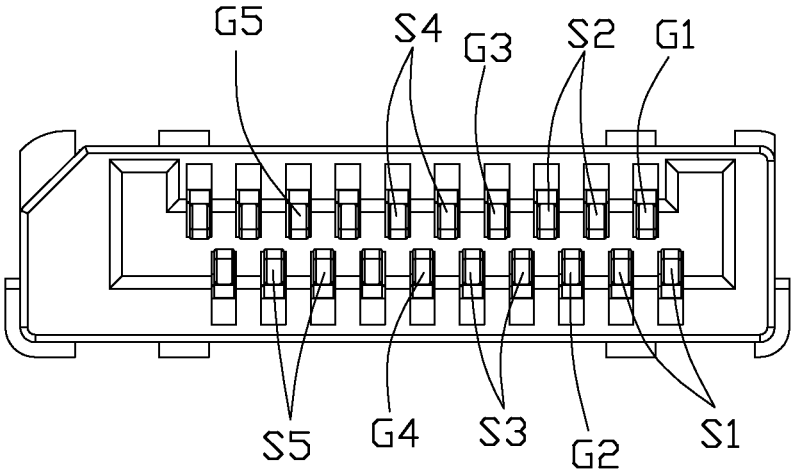
FIG. 7 is a front view of the terminals and the insulated housing assembled with each other of FIG. 5.
Figure 8:
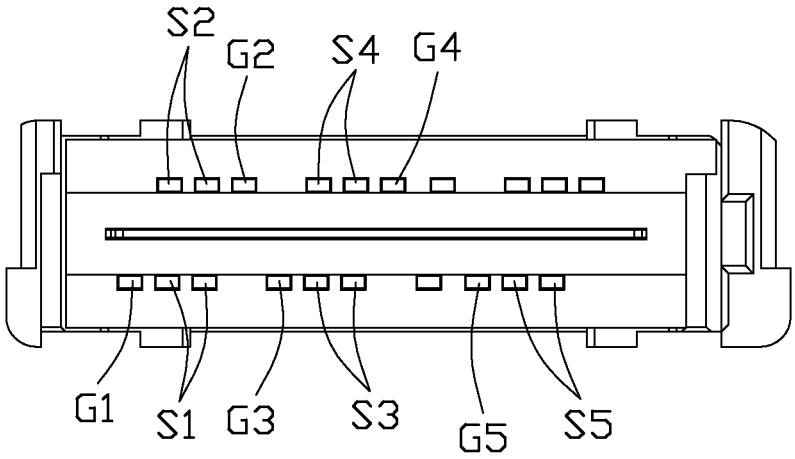
FIG. 8 is a back view of the terminals and the insulated housing assembled with each other of FIG. 5.
Figure 9:
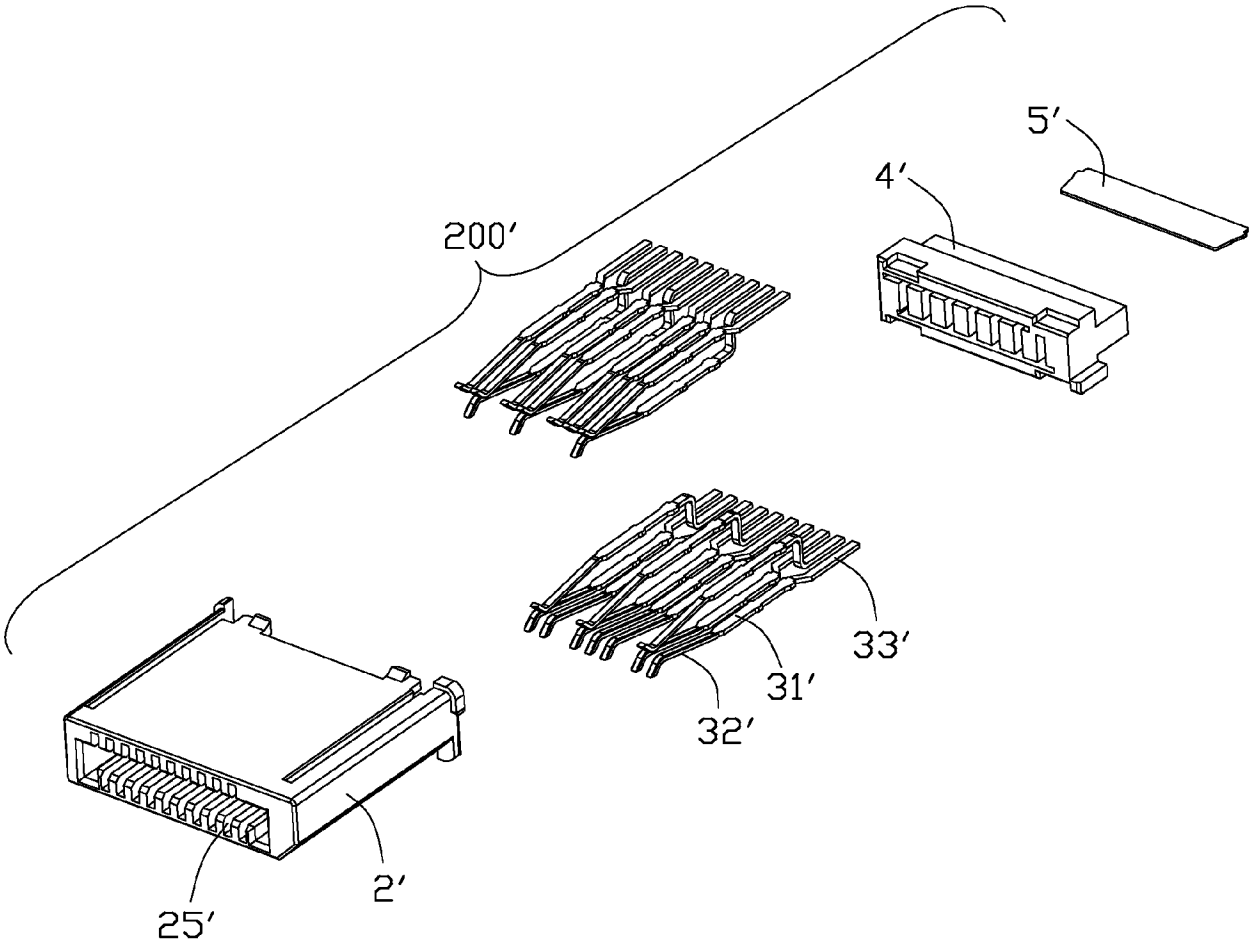
FIG. 9 is an exploded, perspective view of an insulated housing, a number of terminals, a spacer and a metallic plate of the cable assembly in accordance with a second embodiment of the present invention.
Figure 10:
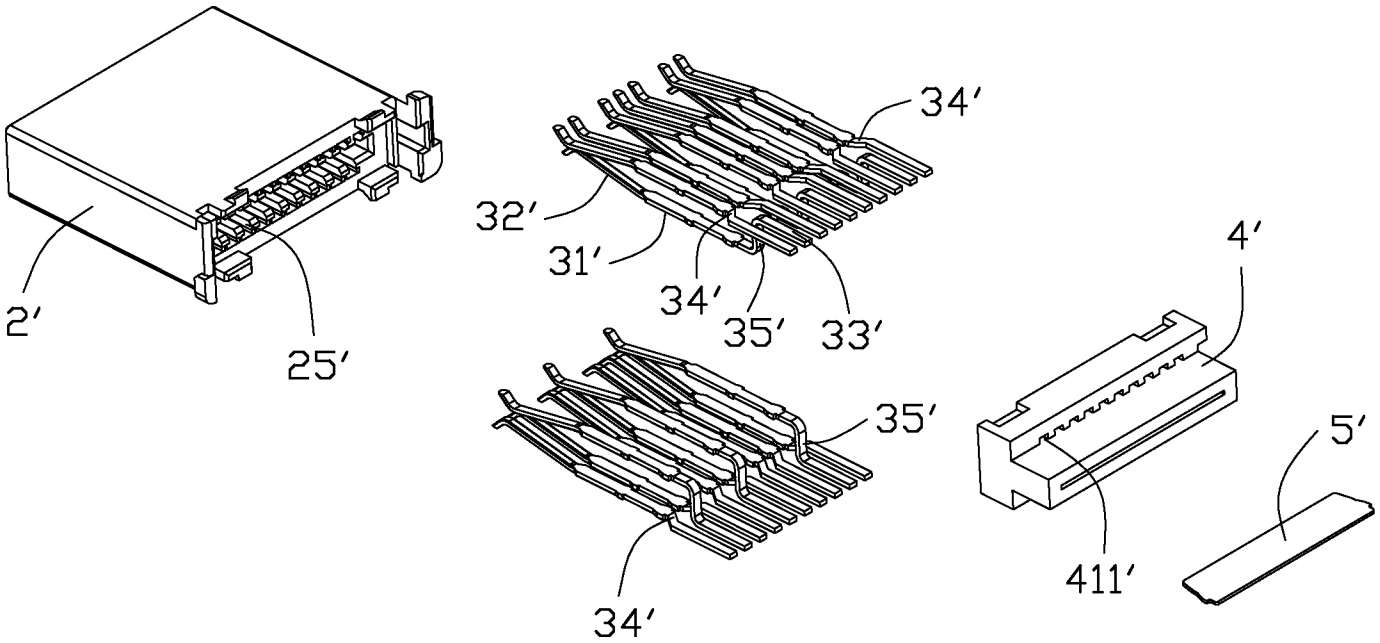
FIG. 10 is similar to FIG. 9, but viewed from another aspect.
Figure 11:
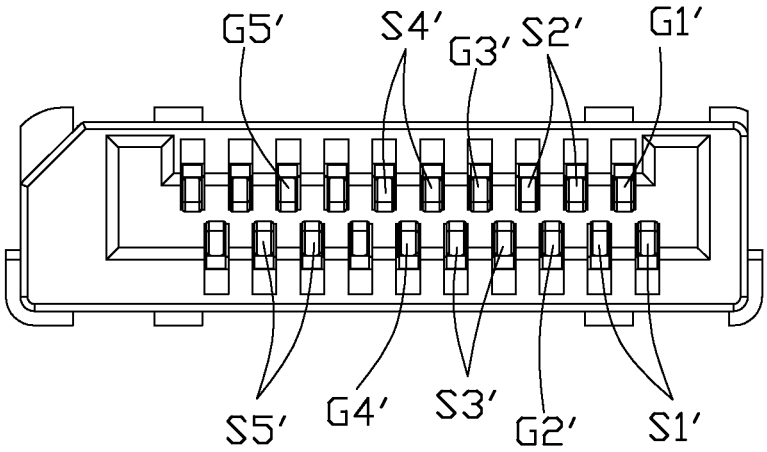
FIG. 11 is a front view of the terminals and the insulated hosing assembled with each other of FIG. 10.
Figure 12:
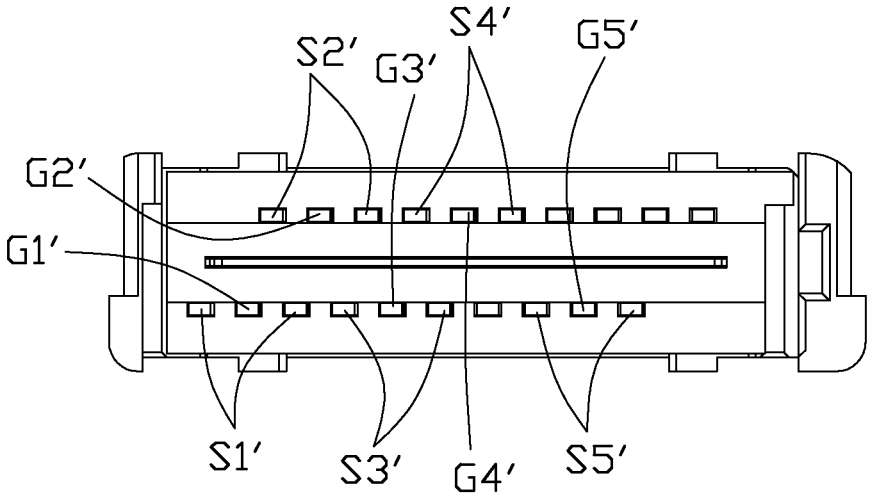
FIG. 12 is a back view of the terminals and the insulated housing assembled with each other of FIG. 10.

Referring to FIGS. 4-6, a plurality of terminals 3 are divided into an upper and lower rows and accommodated in the insulated housing 2. Each terminal 3 comprises a flat body portion 31, a curved mating portion 32 extending forward from a front end of the body portion 31, and an terminating portion 33 extending rearwardly from a rear end of the body portion 31. The terminal 3 further comprises a bending portion 34, 35 connected with the body portion 31 and the terminating portion 33.

Referring to FIGS. 4-8, a plurality of terminals 3 are divided into five terminal groups S1,G1; S2,G2; S3,G3; S4,G4; S5,G5. Each terminal group has a differential pair of signal terminals S1~S5 and a grounding terminal G1~G5. In each group, the mating portions 32 of the pair of differential signal terminals S1~S5 are located on a same row, and the mating portion 33 of the grounding terminal G1~G5 is located on another row. The two mating portions 32 of a differential pair of signal terminals S1~S5 and a mating portion 32 of a grounding terminal G1~G5 are arranged into isosceles triangular configuration in a vertical plane. The terminating portions 33 of the differential pair of signal terminals S1~S5 are deflected from the body portion 31 along a transversal direction perpendicular to a mating direction of the cable assembly 100 and connects with the body portion 31 through a bending portion 34. And the terminating portion 33 of the grounding terminal G1~G5 is deflected from the body portion 31 along a vertical direction perpendicular to mating direction of the cable assembly 100 and connects with the body portion 31 through the bending portion 35. The terminating portions 33 and the bending portions 34 of the differential pair of signal terminals S1~S5 are on a same horizontal plane. Two bending portions 34 of the differerntial pair of signal terminals S1~S5 are parallelled with each other. The bending portion 35 of the grounding terminal G1~G5 is located on a vertical plane perpendicicular to the horizontal plane. The terminating portion 33 of the grounding terminal G1~G5 and the terminating portions 33 of the pair of differential signal terminals S1~S5 are located on a same horizontal plane. And the terminating portion 33 of the grounding terminal G1~G5 is located on a lateral side of the two terminating portions 33 of the differerntial pair of signal terminals S1~S5.

Referring to FIGS. 4-6, the bending portions 34 of the differential signal terminals S1, S3, S5 of the upper row of terminals 3 extend along a left-to-right direction. And the bending portions 34 of the differential signal terminals S2, S4 of the lower row of terminals 3 extend along a right-to-left direction. The bending portions 35 of the grounding terminal G2,G4 of an upper row of terminals 3 extend along an up-to-down direction. And the bending portions 35 of the grounding terminal G1,G3,G5 of an lower row of terminals 3 extends along a down-to-up direction. Thus, the terminating portions 33 of each group are located on a same row. And all the terminating portions 33 of terminals 3 are concentrated to middle section of the insulated housing 2. And two pairs of signal terminals 51, S3; S2, S4; S3, S5 of two groups of terminals 3 are separated by a grounding terminal G2, G3,G4.

Referring to FIGS. 4-5, the spacer 4 assembled to the insulated housing 2 comprises a base portion 43, a tongue portion 41 extending rearwardly from a back surface of the base portion 43. The base portion 43 defines a plurality of receiving holes 430 depressed from the front surface thereof and a plurality of channels 411 throughout the rear face thereof. The channels 411 extends to the upper and the lower surface of the tongue portion 41 and connects with the receiving holes 430. The tongue portion 41 is defined receiving slot 410 depressed from the back surface thereof.

Referring to FIGS. 5-6, the cable assembly 100 further comprises a metallic plate 5 received into the receiving slot 410 in the rear portion 43 of the spacer 4 and located between the upper an lower terminal rows.

Referring to FIGS. 1-3, the cover 6 comprises an upper cover 61 and a lower cover 62 assembled with the upper cover 61. The upper cover 61 and the lower cover 62 respectively defines a mounting hole 610, 620 and a mounting posts 611, 621 cooperated with corresponding mounting holes 610, 620. The upper cover 61 and the lower cover 62 are respectively defines a positioning post 612, 622 and a positioning groove 613, 623 respectively cooperated with the positioning post 612, 622. The upper cover 61 also defines a button 614 used to control locking arm 130 moved along a vertical direction.

Referring to FIGS. 1-3, the cable 7 comprise a number of wires (not shown) separated into an upper row and a lower row. The wires also have same arrangement as that of the terminals 3.

Referring to FIGS. 1-8, the assembling process of the cable assembly 100 made in according to the first embodiment of present invention comprises following steps. Firstly, the terminals 3 are arranged on the spacer 4. The mating portions 33 are located beyond a front surface of the base portion 43. The terminating portions 33 are passed through the receiving holes 430 and the channels 411 and extended to upper and lower surfaces of the tongue portion 41. Secondly, the metallic plate 5 is assembled into the receiving slot 410 of the spacer 4. Thirdly, the terminals 3 and the spacer 4 are together assembled to the insulated housing 2 until the base portions 41 abuts against rear surface of the insulated housing 2. The mating portions 32 of the terminals 3 are received in the terminal passages 25 of the insulated housing 2. The protruding portions 210 of the insulated housing 2 are received in the cutouts 421 of the base portions 43 of the spacer 4.

Fourthly, the conductive wires of the cable 7 are respectively soldered to the terminating portions 33 of the terminals 3. Fifthly, the insulated housing 2 is enclosed by the front frame portion 11 of the first shield portion 1*a* of the metallic shell 1. Thus, the pair of locking members 211 of the two protruding portions 210 of the insulated housing 2 are inserted into the pair of apertures 1131 of the rear section of the top side 113 of the frame portion 11. Simultaneously, the base portion 43 of the spacer 4 and the exposed wires are received into the rear U-shaped portion 12 of first shield portion 1*a* of the metallic shell 1. Then second shield portion 1*b* is assembled to the first shield portion 1*a*. Thus, the tabs 133 of the top section 131 of the second shield portion 1*b* are passed through corresponding holes 1110 of the top side 111 of the first shield portion 1*a*. The locking tabs 134 of the side section 132 of the second shield portion 1*b* are engaged with the locking holes 123 of the side section 121 of the first shield portion 1*a*. Sixthly, the cover 6 is assembled to the metallic shell 1.

After the above assembling steps, the entire process of assembling of the cable assembly 100 is finished. As two terminating portions 33 of the differential pair of signal terminals S1~S5 and a terminating portion 33 of the grounding signal G1~G5 of each terminal group are located on the same row. Thus, the signal and grounding conductive wires will not be separated for a long distance, and the metallic shielding layer of the cable is only needed to be peeled for a short distance to meet signal and grounding conductive wires electrically connected to the terminating portions 33 of the terminals 3 at the same time. As a result, the crosstalk between the wires of the cable will be reduced.

Referring to FIGS. 9-12, a cable assembly 100' in accordance with a second embodiment of the present invention is disclosed. The cable assembly 100' is similar to the cable assembly 100 except the arrangement of a plurality of terminals 3'. The plurality of terminals 3' divided into several terminal group S1',G1'; S2',G2'; S3',G3'; S4',G4'; S5',G5'. Each terminal group comprises a pair of signal terminals S1'~S5' and a grounding terminal G1'~G5'. Each terminal 3' defines a flat body portion 31', a curved mating portion 32' extending forward from a front end of the body portion 31', and an terminating portion 33' extending rearwardly from a rear end of the body portion 31'. The terminal 3' further comprises a bending portion 34', 35' connected with the body portion 31' and the terminating portion 33'. The two mating portions 32' of a differential pair of signal terminals S1'~S5' and a mating portion 32' of a grounding terminal G1'~G5' of each terminal group are arranged into isosceles triangular configuration in a vertical plane. The terminating portion 33' of the differential pair of signal terminals S1'~S5' and the terminating portion 33' of the grounding terminal G1'~G5' of each terminal group are located on a same row. One of the terminating portions 33' of the differential pair of signal terminals S1'~S5' is deflected from the body portion 31' along right-to-left and connecting with the body portion 31' through a bending portion 34', and another is deflected from the body portion 31' along left-to-right connecting with the body portion 31' through a bending portion 34'. Thus, a larger gap is form between the two terminating portion 33' of the differential pair of signal terminals S1'~S5'. And the terminating portion 33' of the grounding terminal G1'~G5' is extended into the gap and located between the two terminating portions 33' of the differerntial pair of signal terminals S1'~S5'. As two terminating portions 33 of the differential pair of signal terminals S1~S5 and a terminating portion 33 of the grounding signal G1~G5 of each terminal group are located on the same row. Thus, the signal and grounding conductive wires will not be separated for a long distance, and the metallic shielding layer of the cable is only needed to be peeled for a short distance to meet signal and grounding conductive wires electrically connected to the terminating portions 33 of the terminals 3 at the same time. As a result, the crosstalk between the wires of the cable will be reduced.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

an insulated housing defining a plurality of terminal passages;

a metallic shell shielding the insulated housing;

a spacer assembled to a rear end of the insulated housing;

a plurality of terminals received into the insulated housing and divided into several terminal groups, each terminal group comprises a pair of signal terminals and a grounding terminal, each terminal defining a body portion, a mating portion extending forwardly from a front end of the body portion, and a terminating portion extending rearwardly from a rear end of the body portion; and a cable electrically connected with the plurality of terminals;

wherein the terminating portions of the pair of signal terminals and the terminating portion of the grounding terminal of the each terminal group are located in a same plane, and the mating portions of the pair of signal terminals and the mating portion of the grounding terminal of the each terminal group are arranged with an isosceles triangular configuration viewed in a vertical plane;

wherein the terminating portion of the grounding terminal is located on a lateral side of the terminating portions of the pair of signal terminals; and wherein the each terminal further comprises a bending portion connected to the body portion and terminating portion, the bending portions and the terminating portions of the pair of signal terminals are located on a same horizontal plan and are paralleled with each other.

2. A cable assembly comprising:

an insulated housing defining a plurality of terminal passages;

a metallic shell shielding the insulated housing;

a spacer assembled to a rear end of the insulated housing;

a plurality of terminals received into the insulated housing and divided into several terminal groups, each terminal group comprises a pair of signal terminals and a grounding terminal, each terminal defining a body portion, a mating portion extending forwardly from a front end of the body portion, and a terminating portion extending rearwardly from a rear end of the body portion; and a cable electrically connected with the plurality of terminals;

wherein the terminating portions of the pair of signal terminals and the terminating portion of the grounding terminal of the each terminal group are located in a same plane, and the mating portions of the pair of signal terminals and the mating portion of the grounding terminal of the each terminal group are arranged with an isosceles triangular configuration viewed in a vertical plane;

wherein the terminating portion of the grounding terminal is located between the terminating portions of the pair of signal terminals; and wherein the each terminal further comprises a bending portion connected to the body portion and terminating portion, the bending portions and the terminating portions of the pair of signal terminals are located on a same horizontal plan and are angled with each other.

3. An electrical connector assembly comprising:

an insulative housing defining a front mating cavity and a rear terminating port in a front-to-back direction;

first and second rows of terminals disposed in the insulated housing, each row extending along a lengthwise direction perpendicular to said front-to-back direction while said first and second rows being opposite to each other in a transverse direction perpendicular to said front-to-back direction and said lengthwise direction, each of said terminals defining a front mating portion and a rear terminating portion, the front mating portions and the rear terminating portions of said terminals being arranged in said first and second rows, said terminals further categorized with differential pairs of signal terminals and grounding terminals roughly alternately arranged with each other so as to form a plurality of sets, each set including one differential pair of signal terminals and one grounding terminal;

wherein, in the each set, the front mating portions of the corresponding differential pair of signal terminals and the grounding terminal are configured as a triangle in a front view with that of the grounding terminal being at an apex of said triangle in one of said first and second rows while the differential pair of signal terminals in the other of said first and second rows, and all the rear terminating portions of said differential pair of signal terminals and said grounding terminal are arranged in only one of said first and second rows;

wherein, in the each set, compared with the rear terminating portions, the front mating portions of the differential pair of signal terminals extend in an offset manner, in the lengthwise direction while the front mating portion of the grounding terminal extends without substantial offset in the lengthwise direction;

wherein, in the each set, the front mating portions of the differential pair of signal terminals extend toward a same direction in said lengthwise direction under condition that the rear terminating portions of the differential pair are located on a same side of that of the grounding terminal viewed along the front-to-back direction; and wherein in each row, the front mating portions of said terminals defines a constant pitch while the rear terminating portions of said terminal defines at least two different pitches thereof.

* * * * *